US005764210A

United States Patent [19]

Moon

[11] Patent Number: 5,764,210

[45] Date of Patent: Jun. 9, 1998

[54] DRIVING APPARATUS FOR LIQUID CRYSTAL DISPLAY

[75] Inventor: Beom Jin Moon, Kyungki-do, Rep. of Korea

[73] Assignee: LG Electronics Inc., Seoul, Rep. of Korea

[21] Appl. No.: 504,715

[22] Filed: Jul. 20, 1995

[30] Foreign Application Priority Data

Jul. 21, 1994 [KR] Rep. of Korea ..... 1994-17692

[51] Int. Cl.[6] ..... G09G 3/36

[52] U.S. Cl. ..... 345/90; 345/94

[58] Field of Search ..... 345/87, 90, 93, 345/98, 94, 99, 100, 204, 208

[56] References Cited

U.S. PATENT DOCUMENTS 3,996,456 12/1976 Hoover .

4,525,710 6/1985 Hoshi et al. ..... 345/90

5,283,477 2/1994 Shibata ..... 345/98

5,537,129 7/1996 Okada et al. ..... 345/90

*Primary Examiner*—Regina Liang

*Attorney, Agent, or Firm*—Finnegan, Henderson, Farabow, Garrett & Dunner, L.L.P.

[57] ABSTRACT

A driving apparatus for a liquid crystal display is disclosed including a liquid crystal display panel for displaying an image signal, a scan line driver for driving pixels of the liquid crystal display panel in units of lines, a signal line driver for applying image data to the pixels of the liquid crystal display panel, a video signal processor for processing an externally input composite video signal, a common electrode correcting circuit for gain-controlling an integration value of one period of the video signal output from the video signal processor to thereby output a common electrode correcting signal, and a common electrode driving circuit for applying the output signal of the common electrode correcting circuit to common electrodes of the respective pixels of the liquid crystal display panel.

7 Claims, 7 Drawing Sheets

DRIVING APPARATUS FOR LIQUID CRYSTAL DISPLAY

BACKGROUND OF THE INVENTION

The present invention relates to a liquid crystal display, and more particularly, to a driving apparatus for a liquid crystal display suitable for reducing crosstalk caused by the voltage distortion of the common electrode in accordance with the data voltage variation of the source driver.

FIG. 1 shows a conventional driving apparatus for a liquid crystal display. Referring to FIG. 1, the conventional driving apparatus consists of a liquid crystal display panel 1, gate drivers 2*a* and 2*b*, source drivers 3*a* and 3*b*, a controller 4, and a video signal processor 5. The liquid crystal display panel 1 includes a plurality of gate bus lines $^{36}{}_{1-n}$, disposed in one direction and separated by predetermined intervals, a plurality of data bus lines $37_{1-m}$ perpendicular to the gate bus lines and also separated by predetermined intervals, and a plurality of pixels arranged between the gate and data bus lines to display image signals. The gate drivers 2*a* and 2*b* drive the pixels of liquid crystal display panel 1 by dividing them into odd and even lines. The source drivers 3*a* and 3*b* supply image signal data to the respective pixels of liquid crystal display panel 1. The video signal processor 5 processes an externally input composite video signal and supplies it to source drivers 3*a* and 3*b*. The controller 4 controls the whole system including gate drivers 2*a* and 2*b*, source drivers 3*a* and 3*b*, and video signal processor 5 to synchronize the display of the image signal.

The operation of the conventional liquid crystal display will be discussed below. As an example, the following discussion will address the case where it is desired to display a rectangular white window pattern over a grey background on a normally-black LCD. FIG. 2A shows the desired display screen and FIG. 2B shows the actual display screen distorted by crosstalk.

A normally-black LCD allows no light to pass through it when no voltage is applied to the pixels in the LCD. In contrast, a normally-white LCD allows 100% of light to pass through it when no voltage is applied to the pixels in the LCD. In each case, the transmissivity of the pixels in the LCD varies as voltage is applied to the pixels. FIG. 3 shows the graph of transmissivity to light of a pixel in an LCD versus the voltage applied to the pixel for both a normally-black and a normally-white LCD. As shown in FIG. 3, a normally-black LCD has zero transmissivity at 0V, but the transmissivity rises as a function of the voltage until 100% transmissivity is achieved.

When the transmissivity of a pixel is zero, the pixel is black. When the transmissivity of a pixels is 100%, the pixel is white. Each transmissivity value in between zero and 100% corresponds to a shade of gray that may be displayed by a given pixel.

Referring to FIGS. 4, 5A, and 5B, controller 4 controls video signal processor 5, gate drivers 2*a* and 2*b*, and source drivers 3*a* and 3*b* so that gate drivers 2*a* and 2*b* drive the thin film transistors of the respective pixels. By doing so, the image signal processed in video signal processor 5 is displayed on liquid crystal panel 1 via source drivers 3*a* and 3*b*. FIG. 4 shows a screen division state in accordance with gate and data voltages when a white window pattern is displayed on the screen in a normally black mode. This screen division state results in the display screen shown in FIG. 2B.

As seen in FIG. 2B, when the white window pattern is displayed on the screen, sometimes the brightness of the periphery of the window pattern is darker than the background color. This phenomenon is called crosstalk, specifically horizontal crosstalk. Crosstalk is discussed at length in "Analysis of Area-Distributed Crosstalk Phenomena in Large Area TFT-LCDs," SID 94 Digest, pages 463–466, and "An Analysis of source bus-line to common-electrode Coupling Effect in Large-Area TFT-LCDs," Journal of the SID, 1/1, 1993, pages 81–87. Horizontal crosstalk is caused by the coupling effect between the bus lines and common electrode. Specifically, the voltage variation of the gate bus lines and data bus lines creates the voltage variation of the common electrode so that the voltages applied at either end of the liquid crystal are greater or smaller than required for proper display. This divides the screen horizontally in the form of a line or plane. As the screen becomes larger, this effect becomes more severe.

FIGS. 5A and 5B show, respectively, the source signal $V_s$ and the common electrode signal $V_c$ in which crosstalk is caused according to the conventional driving apparatus and method. The magnitude of the voltage of the source signal $V_s$ varies from $V_{sb}$ to $V_{sw}$. FIG. 5A shows $V_s$ at two different places on the display screen, at a place containing the white window pattern (A) and at a place not containing the white window pattern (B). For the period between $t_o$ and $t_{on}$ in which a voltage is applied to the pixels, the common electrode signal should vary from $V_{cmax}$ to $V_{cO}$, as shown in FIG. 5B. If in this state $V_c$ does not reach $V_{cO}$ in the period from $t_O$ to $t_{on}$ i.e., it only falls to a voltage greater than $V_{cO}$, then the error of $\Delta V_c$ is produced. This causes horizontal crosstalk. The error of $\Delta V_c$ reduces the voltage applied to the pixels, decreasing the transmissivity of a normally-black LCD and thus rendering the periphery of the screen darker than the background.

In the conventional driving apparatus for liquid crystal display, the coupling effect between the bus lines and common electrode causes voltage variation of the common electrode so that the applied voltages at either end of the liquid crystal are greater or smaller than required for the proper display. This produces crosstalk and deteriorates picture quality. As the screen becomes larger and resolution becomes higher, this effect becomes more severe.

SUMMARY OF THE INVENTION

Therefore, it is an object of the present invention to provide a driving apparatus for a liquid crystal display, which eliminates crosstalk.

To accomplish the object of the present invention, there is provided a method for modifying a common electrode voltage signal in an LCD module based on an input data signal and an unmodified common electrode signal, the method including the steps of integrating the data signal, sampling and holding the data signal to form a correction signal, amplifying the correction signal, and adding the amplified correction signal to the unmodified common electrode voltage to form a modified electrode voltage.

There is also provided an apparatus for modifying a common electrode voltage signal in an LCD module based on an input data signal and an unmodified common electrode signal, comprising a means for integrating the data signal, a means for sampling and holding the data signal to form a correction signal, a means for amplifying the correction signal, and a means for adding the amplified correction signal to the unmodified common electrode voltage to form a modified electrode voltage.

There is also provided an apparatus for modifying a common electrode voltage signal in an LCD module based on an input data signal and an unmodified common electrode signal, comprising an integrator for integrating the data signal, a sampling/holding portion for sampling and holding the data signal to form a correction signal, an amplifier for amplifying the correction signal, and an adder for adding the amplified correction signal to the unmodified common electrode voltage to form a modified electrode voltage.

There is also provided a driving apparatus for a liquid crystal display comprising: a liquid crystal display panel for displaying an image signal; a scan line driver for driving pixels of the liquid crystal display panel in units of lines; a signal line driver for applying image data to the pixels of the liquid crystal display panel; a video signal processor for processing an externally input composite video signal; a common electrode correcting circuit for gain-controlling an integration value of one period of the video signal output from the video signal processor to thereby output a common electrode correcting signal; and a common electrode driving circuit for applying the output signal of the common electrode correcting circuit to common electrodes of the respective pixels of said liquid crystal display panel.

BRIEF DESCRIPTION OF THE ATTACHED DRAWINGS

DETAILED DESCRIPTION OF A PREFERRED EMBODIMENT OF THE INVENTION

Hereinafter, a preferred embodiment of the present invention will be described with reference to the attached drawings.

Figure 1:
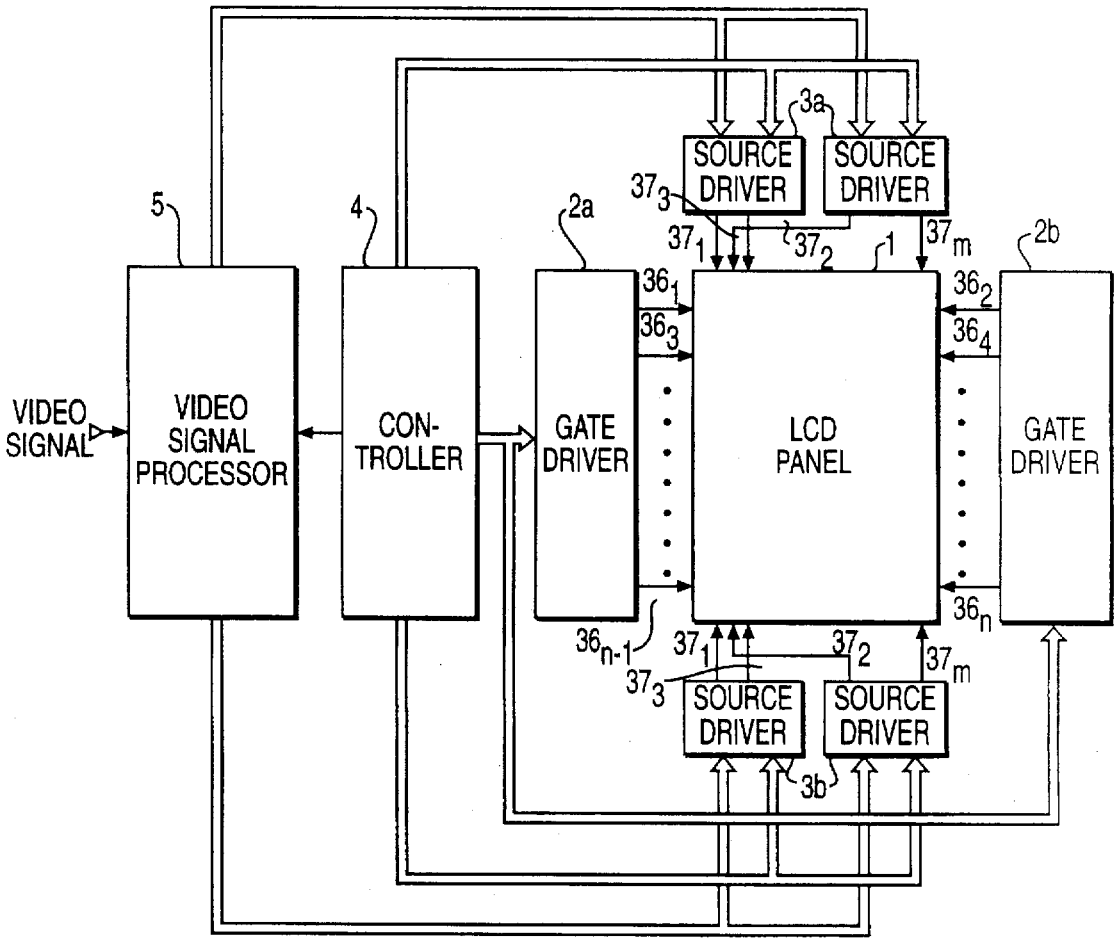
FIG. 1 PRIOR ART
FIG. 1 is a block diagram of a conventional driving apparatus for a liquid crystal display.
Figure 2A:
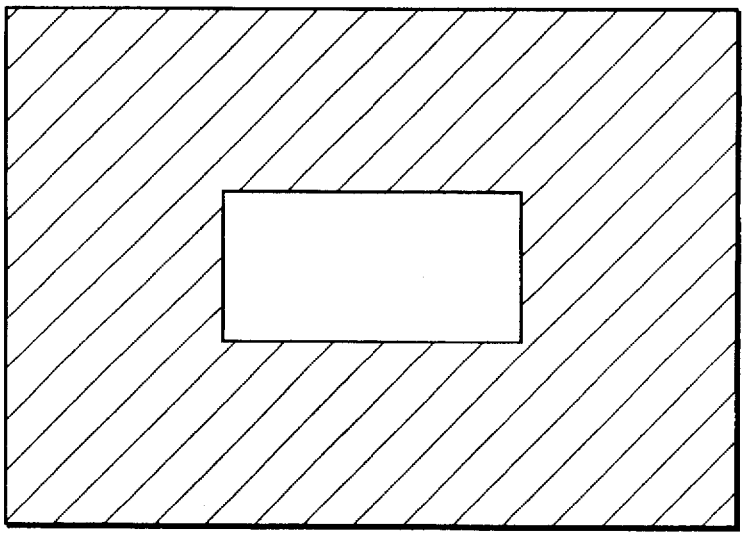
FIG. 2A PRIOR ART
FIG. 2A shows a desired white window pattern to be formed in a normally black mode of the liquid crystal display.
Figure 2B:
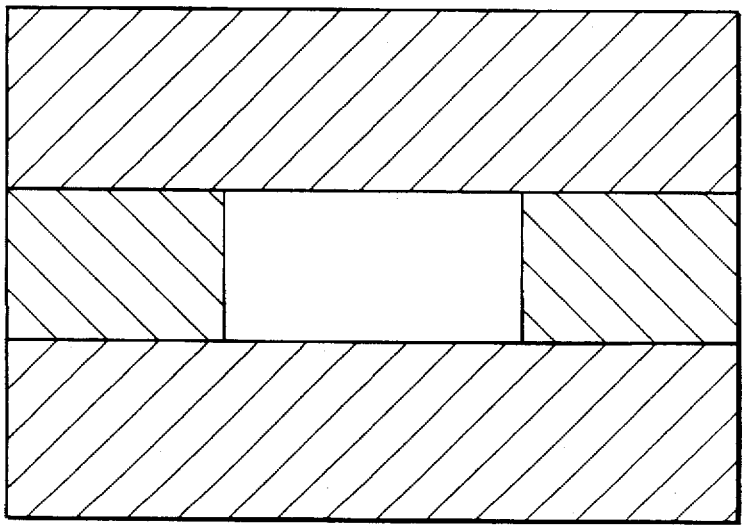
FIG. 2B PRIOR ART
FIG. 2B shows an actual white window pattern formed in a normally black mode of a conventional liquid crystal display.
Figure 3:
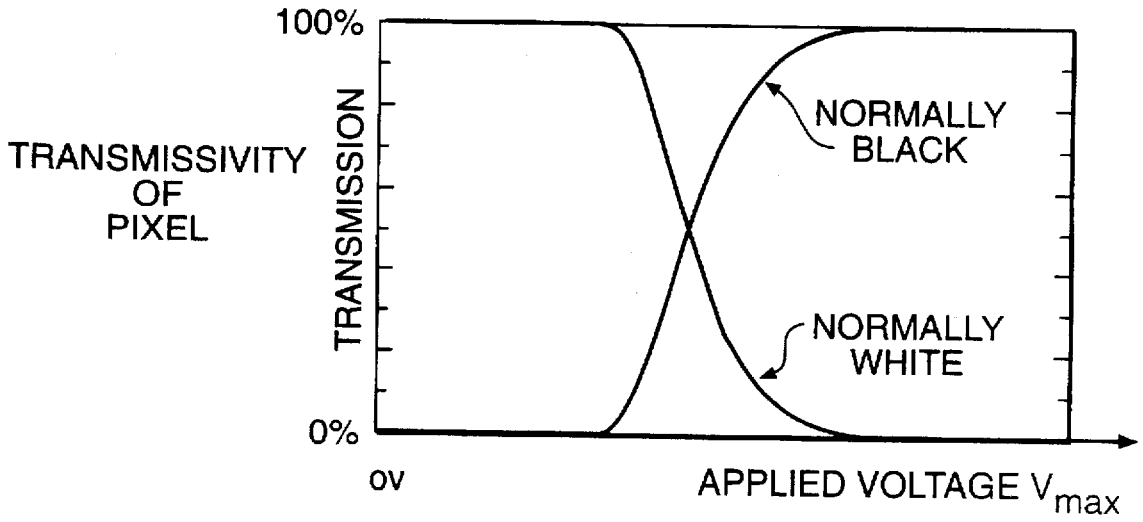
FIG. 3 PRIOR ART
FIG. 3 is a graph showing the relationship between the light transmissivity of an LCD pixel and the voltage applied to the pixel.
Figure 4:
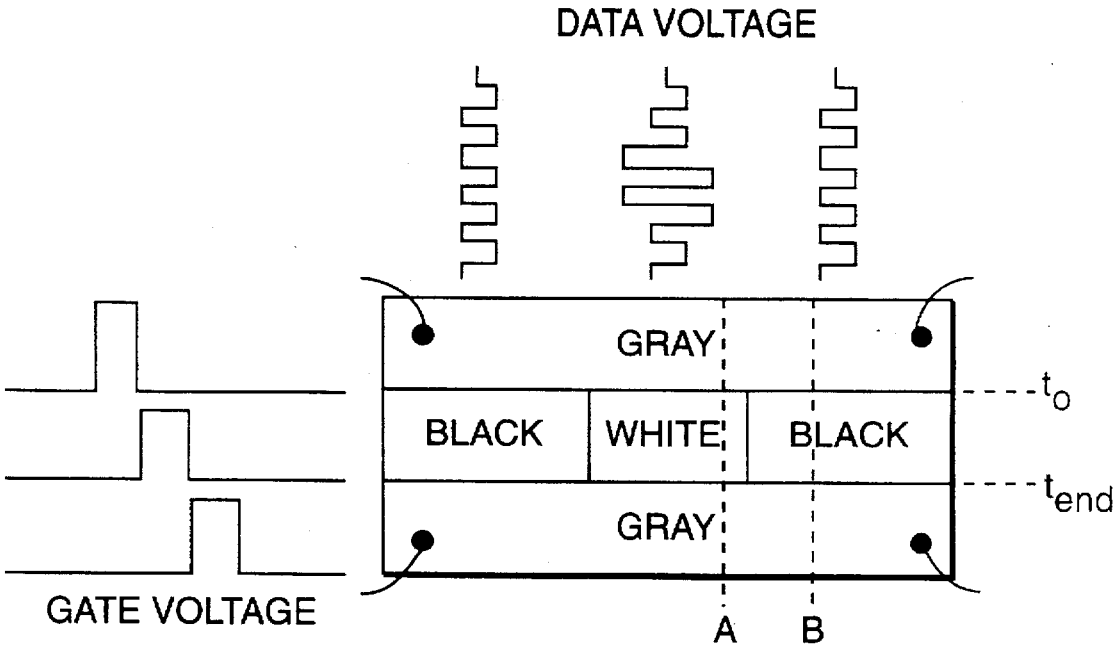
FIG. 4 PRIOR ART
FIG. 4 is a diagram showing a window pattern in accordance with the driving of the conventional liquid crystal display.
Figure 5A:
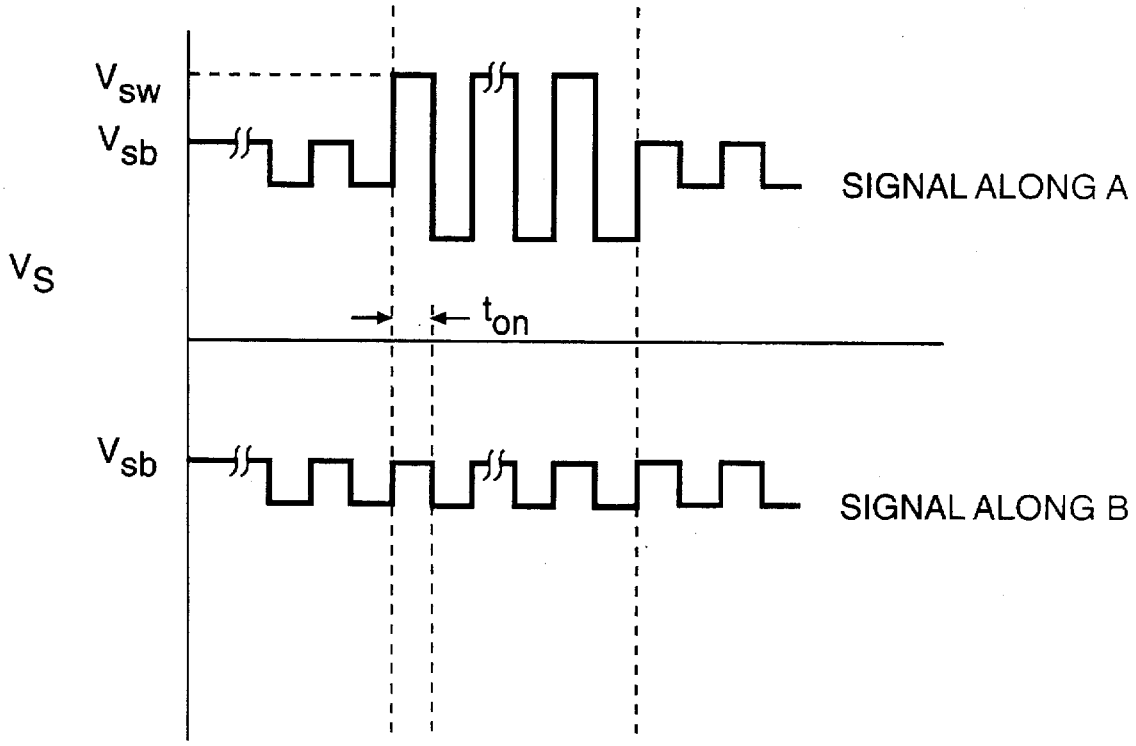
FIG. 5A PRIOR ART
FIGS. 5A and 5B are waveform diagrams of a source voltage and a common signal voltage in accordance with the driving of the conventional liquid crystal display.
Figure 5B:
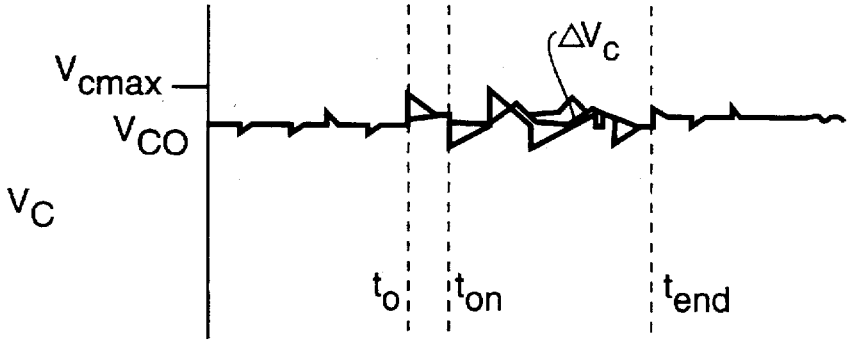
FIG. 5B PRIOR ART
Figure 6:
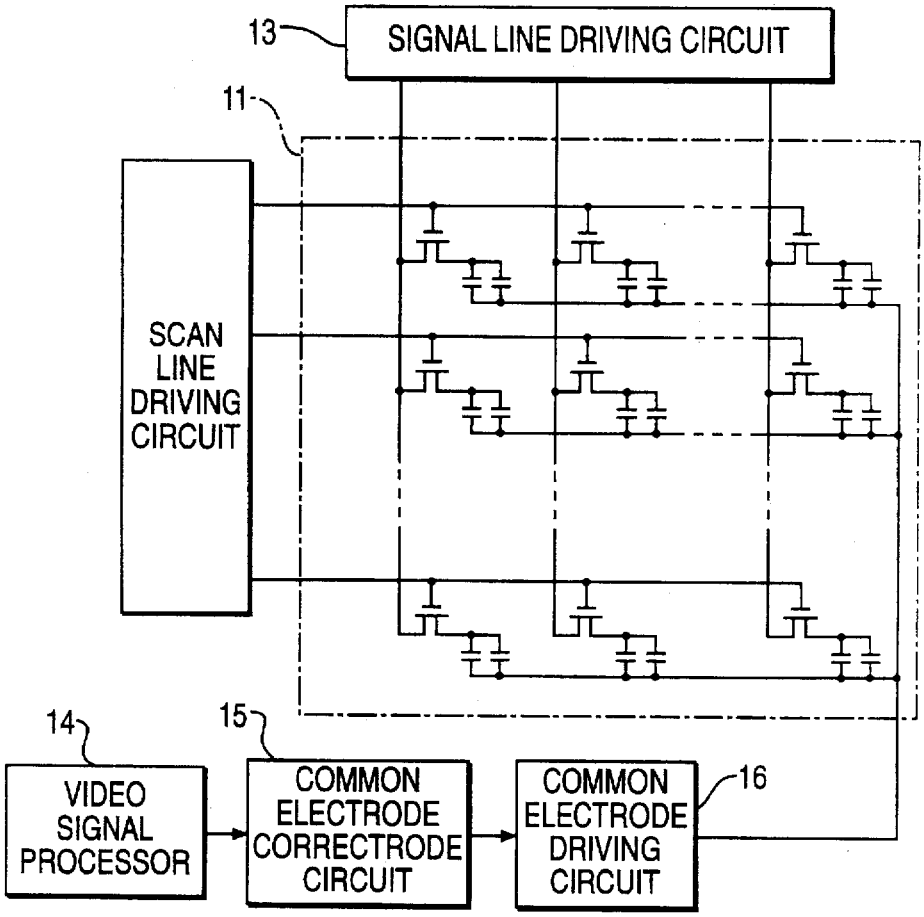
FIG. 6 is a circuit diagram of a liquid crystal display of the present invention.

Referring to FIG. 6, a driving apparatus for a liquid crystal display of the present invention comprises a liquid crystal display panel 11, a scan line driving circuit 12, a signal line driver 13, a video signal processor 14, a common electrode correcting circuit 15, and a common electrode driving circuit 16.

The liquid crystal display panel 11 comprises a plurality of gate bus lines disposed in one direction and separated by first predetermined intervals, a plurality of data bus lines arranged to be perpendicular to the gate bus lines and separated by second predetermined intervals, and a plurality of pixels arranged between the date and data bus lines to display image signals. The scan line driving circuit 12 applies a driving signal to the gate bus lines to drive the pixels of liquid crystal display panel 11 in units of lines. The signal line driver 13 applies image data to the data bus lines. The video signal processor 14 processes an externally input composite video signal. The common electrode correcting circuit 15 samples/holds the integration value of one period of the video signal output from video signal processor 14 in synchronization with the horizontal period and adds the sampled/held value and the signal of a common electrode modulator to output a common electrode correcting signal. The common electrode driving circuit 16 receives the output signal of common electrode correcting circuit 15 and applies it to the common electrode of the respective pixels of liquid crystal display panel 11.

Figure 7:
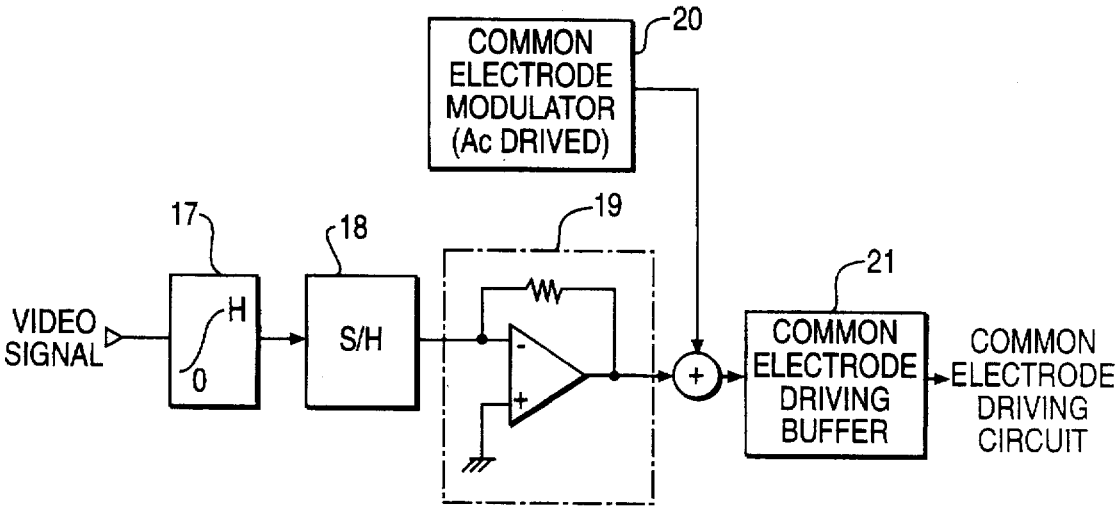
FIG. 7 is a detailed block diagram of the common electrode correcting circuit shown in FIG. 6 of the present invention.

Referring to FIG. 7, common electrode correcting circuit 15 comprises an integrator 17, a sampling/holding portion 18, a gain controller 19, and a common electrode driving buffer 21. The integrator 17 integrates one period of the video signal output from video signal processor 14. The sampling/holding portion 18 samples/holds the integration value of integrator 17 in synchronization with the horizontal period. The gain controller 19 controls the gain of the sampled/held value. And, the common electrode driving buffer 21 adds the value output from gain controller 19 and the alternate driving signal of common electrode modulator 20 and outputs the summed result to common electrode driving circuit 16.

Figure 8A:
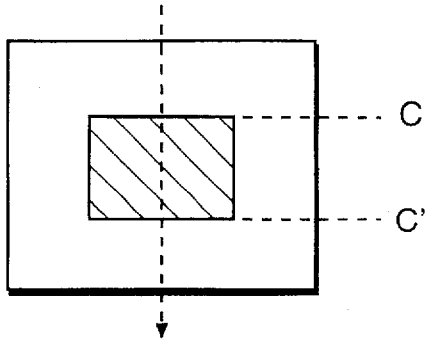
FIG. 8A shows a white window pattern formed in a normally black mode of the liquid crystal display of the present invention.

When the white window pattern is formed on the liquid crystal display in the normally black mode, as shown in FIG. 8A, the waveforms present between window pattern vertical axes C and C' will be explained below.

Figure 8B:
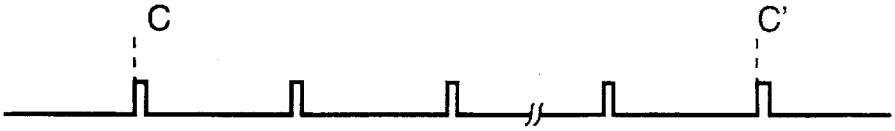
FIGS. 8B–8F are waveforms present at different locations of the signal in the embodiment of FIG. 7.
Figure 8C:
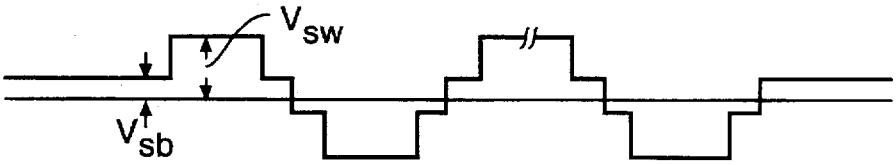
Figure 8D:
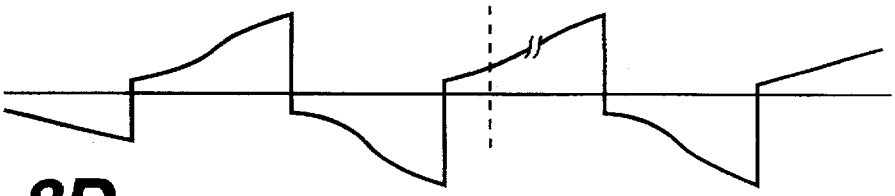
Figure 8E:
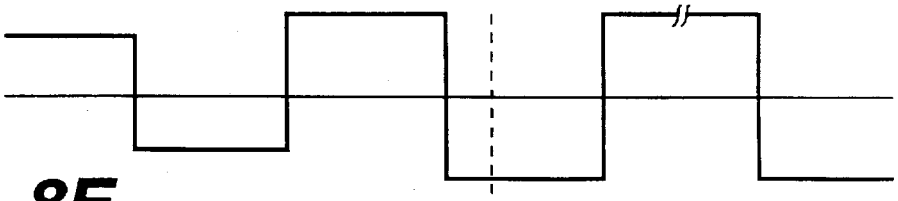
Figure 8F:
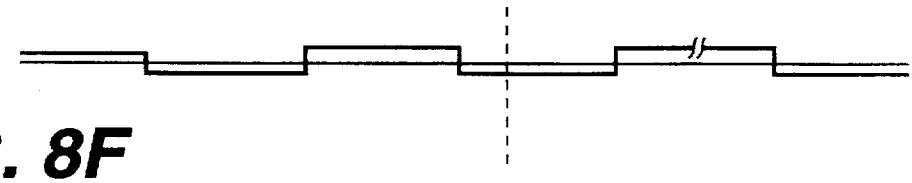

When a video signal data signal is received according to the horizontal sync frequency of the video signal shown in FIG. 8B. The data voltage applied to the liquid crystal via the source driver after one period of the received video signal is as indicated in FIG. 8C. This signal corresponds to the waveform of the common electrode applied to the liquid crystal displaced by one period. The video signal is applied to common electrode correcting circuit 15. Its integration value for one period is taken by integrator 17, and is shown in FIG. 8D. The integration value is stored in sampling/holding portion 18, as shown in FIG. 8E. The data waveform of sampling/holding portion 18 shown in FIG. 8E is applied to gain controller 19, in which its voltage is controlled. This controlled voltage waveform, shown in FIG. 8F, is added to the common electrode signal, generating a corrected common electrode signal.

The addition of the output of the gain controller 19 to the common electrode signal offsets any $\Delta V_c$ that might have occurred, insuring that $V_c$ always falls to $V_0$ and eliminating horizontal crosstalk.

As described above, the driving apparatus of a liquid crystal display of the present invention is advantageous in that input signals are integrated and gain-controlled for every horizontal scan period in order to correct the common electrode signal. This eliminates crosstalk and improves picture quality.

What is claimed is:

1. A method for modifying a common electrode voltage signal in an LCD module based on an input data signal and an unmodified common electrode signal, the method including the steps of:

integrating the data signal;

sampling and holding the data signal to form a correction signal;

amplifying the correction signal; and adding the amplified correction signal to the unmodified common electrode voltage to form the modified common electrode signal.

2. The method of claim 1, wherein the modified common electrode signal is used as the common voltage for the pixels in an LCD module.

3. An apparatus for modifying a common electrode voltage signal in an LCD module based on an input data signal and an unmodified common electrode signal, comprising:

means for integrating the data signal;

means for sampling and holding the data signal to form a correction signal;

means for amplifying the correction signal; and means for adding the amplified correction signal to the unmodified common electrode voltage to form the modified electrode signal.

4. The apparatus of claim 3, wherein the modified common electrode signal is used as the common voltage for the pixels in an LCD module.

5. An apparatus for modifying a common electrode voltage signal in an LCD module based on an input data signal and an unmodified common electrode signal, comprising:

an integrator for integrating the data signal;

a sample/hold portion for sampling and holding the data signal to form a correction signal;

an amplifier for amplifying the correction signal; and an adder for adding the amplified correction signal to the unmodified common electrode voltage to form the modified electrode signal.

6. The apparatus of claim 5, wherein the modified common electrode signal is used as the common voltage for the pixels in an LCD module.

7. A driving apparatus for a liquid crystal comprising:

a liquid crystal display panel for displaying an image signal;

a scan line driver for driving pixels of said liquid crystal display panel in units of lines;

a signal line driver for applying image data to the pixels of said liquid crystal display panel;

a video signal processor for processing an externally input composite video signal;

a common electrode correcting circuit for gain controlling an integration value of one period of the video signal output from said video signal processor to thereby output a common electrode correcting signal; and a common electrode driving circuit for applying the output signal of said common electrode correcting circuit to common electrodes of the respective pixels of said liquid crystal display panel, wherein said common electrode correcting circuit includes:

an integrator for integrating one period of the video signal output from said video signal processor;

a sampling/holding portion for sampling/holding the integration value of said integrator in synchronization with a horizontal period;

a gain controller for controlling the sampled/held value; and a common electrode driving buffer for summing the value output from said gain controller and the alternate driving signal of a common electrode modulator, and outputting the summed result to said common electrode driving circuit.

* * * * *